US012593896B2

(12) United States Patent
Chua et al.

(10) Patent No.: US 12,593,896 B2
(45) Date of Patent: Apr. 7, 2026

(54) CLEAT STRUCTURE FOR ARTICLE OF FOOTWEAR

(71) Applicant: NIKE, Inc., Beaverton, OR (US)

(72) Inventors: Matthew Chua, Beaverton, OR (US); Oliver McLachlan, Beaverton, OR (US); Christian Alexander Steinbeck, Portland, OR (US); Kristin Yetman, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/959,218

(22) Filed: Nov. 25, 2024

(65) Prior Publication Data

US 2025/0089853 A1 Mar. 20, 2025

Related U.S. Application Data

(63) Continuation of application No. 17/936,154, filed on Sep. 28, 2022, now Pat. No. 12,178,293.

(60) Provisional application No. 63/251,447, filed on Oct. 1, 2021.

(51) Int. Cl.

| | |
|---|---|
| ***A43B 13/22*** | (2006.01) |
| ***A43B 13/12*** | (2006.01) |
| ***A43C 15/16*** | (2006.01) |

(52) U.S. Cl.

CPC ..... *A43C 15/161* (2013.01); *A43B 13/122* (2013.01); *A43B 13/223* (2013.01)

(58) Field of Classification Search

CPC ..... A43B 13/26; A43B 3/0042; A43C 15/161
See application file for complete search history.

(56) References Cited

U.S. PATENT DOCUMENTS

| | | | | |
|---|---|---|---|---|
| 4,347,674 | A * | 9/1982 | George | A43C 13/04 36/67 R |
| 4,689,901 | A * | 9/1987 | Ihlenburg | A43B 3/0042 36/114 |
| D295,231 | S * | 4/1988 | Heyes | D2/962 |
| 5,367,791 | A | 11/1994 | Gross et al. | |
| 6,101,746 | A * | 8/2000 | Evans | A43C 15/162 36/134 |
| 2002/0178619 | A1* | 12/2002 | Schaudt | A43B 5/02 36/67 D |
| 2005/0016029 | A1* | 1/2005 | Auger | A43B 13/125 36/134 |
| 2010/0212190 | A1 | 8/2010 | Schmid | |
| 2011/0107622 | A1* | 5/2011 | Schwirian | A43B 13/122 12/146 B |
| 2011/0197475 | A1 | 8/2011 | Weidl et al. | |
| 2013/0340295 | A1* | 12/2013 | Adami | A43B 13/04 12/146 B |
| 2014/0345166 | A1* | 11/2014 | Koch | A43C 15/162 36/134 |

(Continued)

*Primary Examiner* — Jillian K Pierorazio
(74) *Attorney, Agent, or Firm* — Honigman LLP; Matthew H. Szalach; Jonathan P. O'Brien

(57) ABSTRACT

A sole structure for an article of footwear includes a baseplate defining a ground-contacting surface of the sole structure and at least two ground-engaging members extending from the ground-contacting surface. The at least two ground-engaging members including a first portion and a second portion, the first portions of the ground-engaging members being connected to one another by a bridge formed separately from the baseplate.

20 Claims, 13 Drawing Sheets

(56) References Cited

U.S. PATENT DOCUMENTS

| | | | | |
|---|---|---|---|---|
| 2014/0366402 | A1* | 12/2014 | Cavaliere | A43C 15/161 12/146 B |
| 2015/0374071 | A1* | 12/2015 | Droege | A43C 15/167 36/105 |
| 2016/0206046 | A1* | 7/2016 | Cross | A43B 23/042 |
| 2016/0295960 | A1 | 10/2016 | Rushbrook | |
| 2016/0366983 | A1* | 12/2016 | Minami | A43C 15/161 |
| 2016/0366984 | A1* | 12/2016 | Minami | A43C 15/165 |
| 2016/0374426 | A1* | 12/2016 | Auger | A43B 5/02 36/30 R |
| 2017/0188662 | A1* | 7/2017 | Baucom | A43B 3/0068 |
| 2017/0251752 | A1* | 9/2017 | Baghdadi | A43C 15/16 |
| 2019/0039342 | A1* | 2/2019 | Dyer | B29D 35/122 |
| 2019/0223547 | A1* | 7/2019 | Farr | B32B 27/12 |
| 2019/0343221 | A1* | 11/2019 | Farr | A43B 23/0245 |
| 2021/0259367 | A1* | 8/2021 | Ekstrom | A43B 13/223 |

* cited by examiner

CLEAT STRUCTURE FOR ARTICLE OF FOOTWEAR

CROSS REFERENCE TO RELATED APPLICATIONS

This application is a continuation of U.S. Non-Provisional application Ser. No. 17/936,154, filed on Sep. 28, 2022, which claims priority under 35 U.S.C. § 119(e) to U.S. Provisional Application No. 63/251,447, filed on Oct. 1, 2021. The disclosures of these prior applications are considered part of the disclosure of this application and are hereby incorporated by reference in their entirety.

FIELD

The present disclosure relates generally to an article of footwear and more particularly to a cleat structure for an article of footwear.

BACKGROUND

This section provides background information related to the present disclosure and is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper and include an outsole. The outsole may include a baseplate formed of a rigid or semi-rigid material that provides rigidity and energy distribution across the sole structure. The baseplate may be provided with one or more ground-engaging members for engagement with a ground surface.

While conventional baseplates of sole structures adequately provide a wearer with traction, separately formed ground-engaging members or ground-engaging members that have multiple components and/or materials can cause excess material waste during manufacturing. This material waste is often referred to as runner waste, which is a byproduct of forming a conventional ground-engaging member, or a portion thereof, via an injection-molding process. Such processes typically require runners to supply molten plastic to various regions of a mold to simultaneously form multiple ground-engaging members or portions thereof. Accordingly, conventional sole structures may be designed and function well for a particular activity but may be lacking in manufacturing efficiency and sustainability.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1:
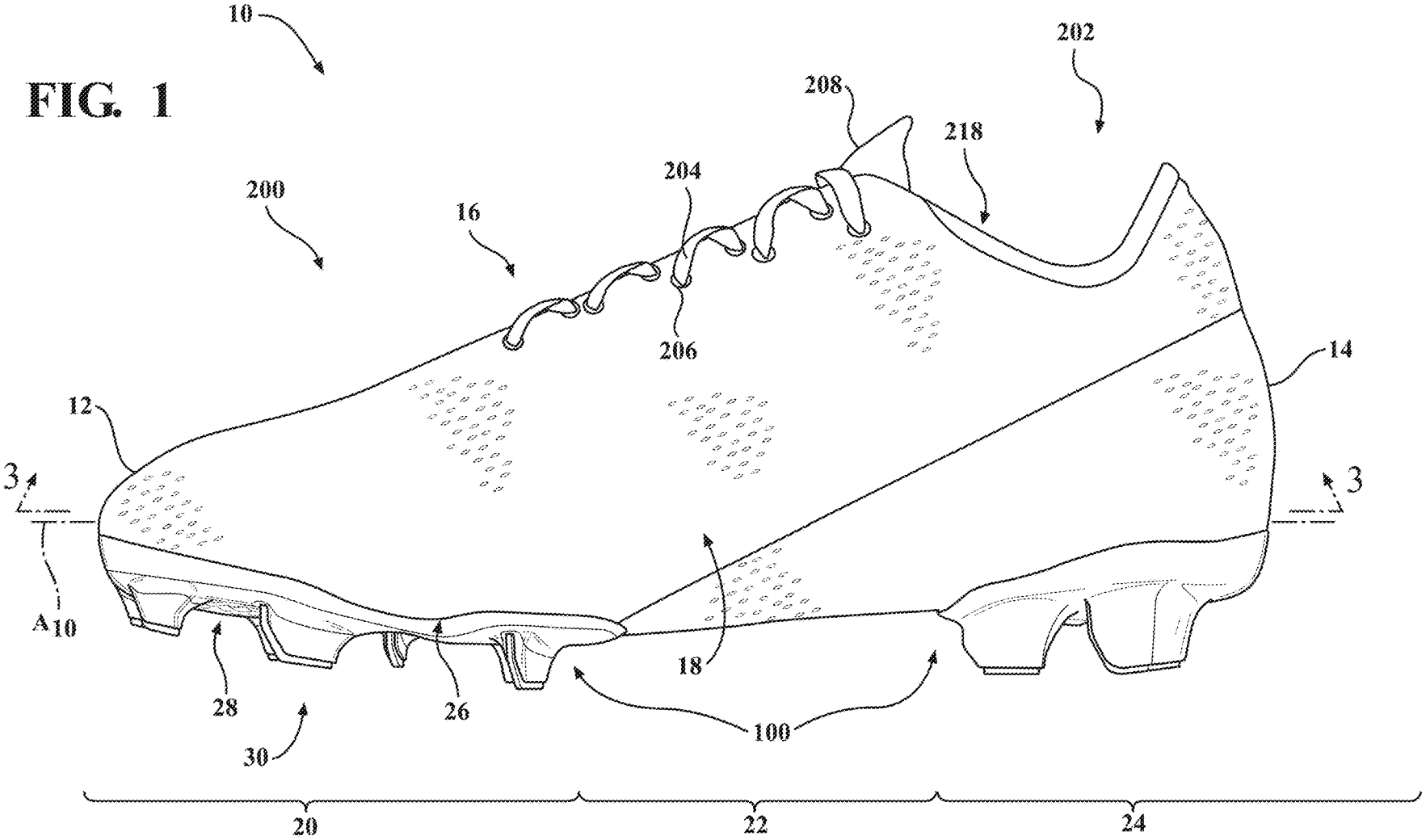
FIG. 1 is a side elevation view of an article of footwear according to the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, a sole structure for an article of footwear includes a baseplate defining a ground-contacting surface of the sole structure and at least two ground-engaging members extending from the ground-contacting surface and including a first portion and a second portion, the first portions of the ground-engaging members being connected to one another by a bridge formed separately from the baseplate.

The sole structure may include one or more of the following optional features. For example, the first portions of the at least two ground-engaging members may be integrally formed with the bridge. Additionally or alternatively, the first portions of the at least two ground-engaging members may be formed from a different material than a material forming the baseplate.

In one configuration, the second portions of the at least two ground-engaging members may be formed from the same material as a material forming the baseplate. Additionally or alternatively, the second portions of the at least two ground-engaging members may be integrally formed with the baseplate.

The first portions of the at least two ground-engaging members may include a first leg extending substantially perpendicular to the ground-contacting surface and a second leg extending from the first leg. The second leg may extend substantially perpendicular to the first leg. Additionally or alternatively, the second leg may extend substantially parallel to the ground-contacting surface. Further, the second leg may define a distal end of the at least two ground-engaging members.

An article of footwear may incorporate the sole structure described above.

In another configuration, a sole structure for an article of footwear includes a baseplate defining a ground-contacting surface of the sole structure and at least two ground-engaging members extending from the ground-contacting surface and including a first portion and a second portion, the first portions of the at least two ground-engaging members being connected to one another by a bridge with the ground-contacting surface extending (i) between and separating the first portions of the at least two ground-engaging members and (ii) substantially parallel to the bridge.

The sole structure may include one or more of the following optional features. For example, the first portions of the at least two ground-engaging members may be integrally formed with the bridge. Additionally or alternatively, the first portions of the at least two ground-engaging members may be formed from a different material than a material forming the baseplate.

In one configuration, the second portions of the at least two ground-engaging members may be formed from the same material as a material forming the baseplate. Additionally or alternatively, the second portions of the at least two ground-engaging members may be integrally formed with the baseplate.

The first portions of the at least two ground-engaging members may include a first leg extending substantially perpendicular to the ground-contacting surface and a second leg extending from the first leg. The second leg may extend substantially perpendicular to the first leg. Additionally or alternatively, the second leg may extend substantially parallel to the ground-contacting surface. Further, the second leg may define a distal end of the at least two ground-engaging members.

An article of footwear may incorporate the sole structure described above.

Figure 2:
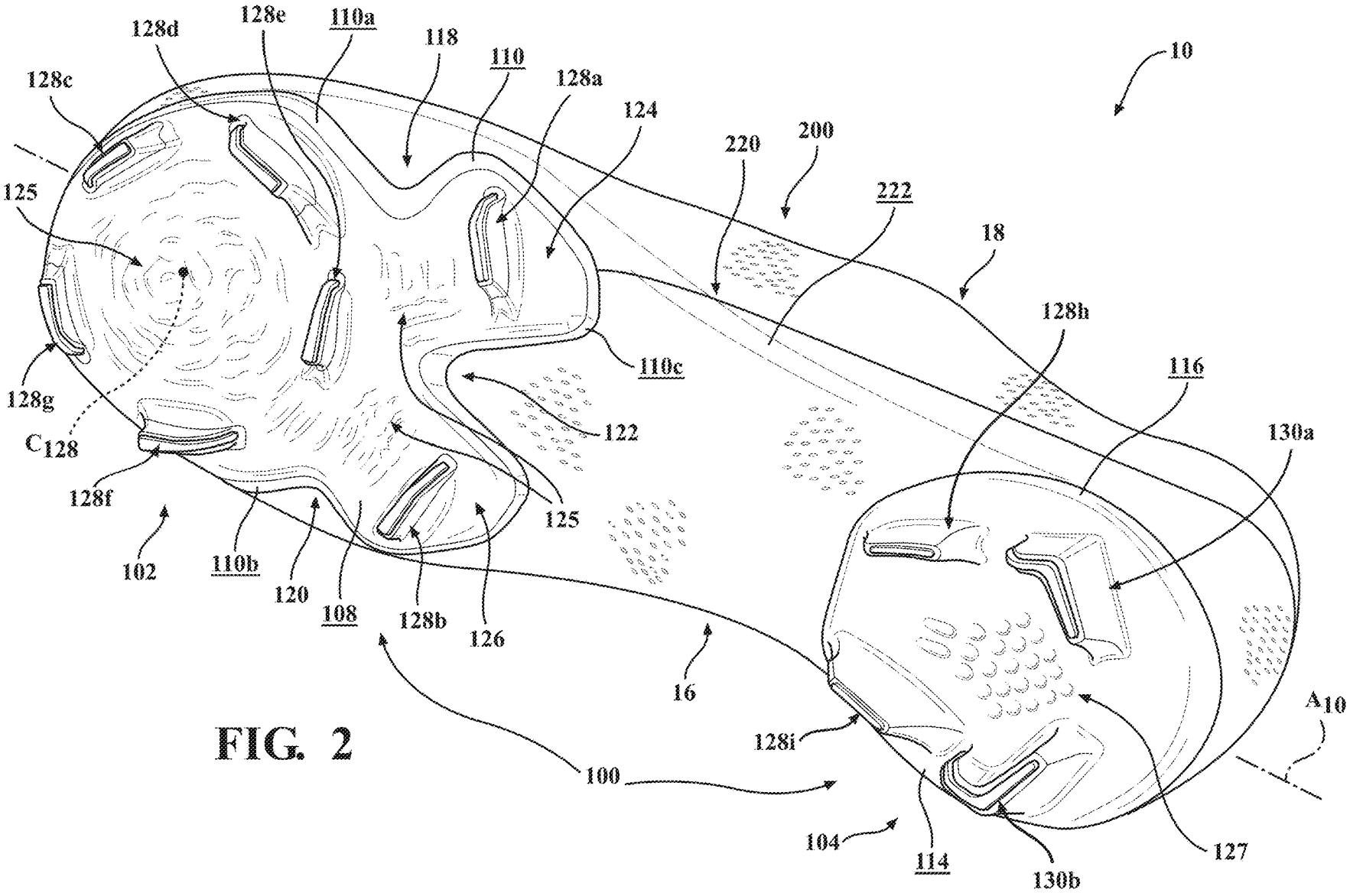
FIG. 2 is a bottom-back perspective view of the article of footwear of FIG. 1.
Figure 3:
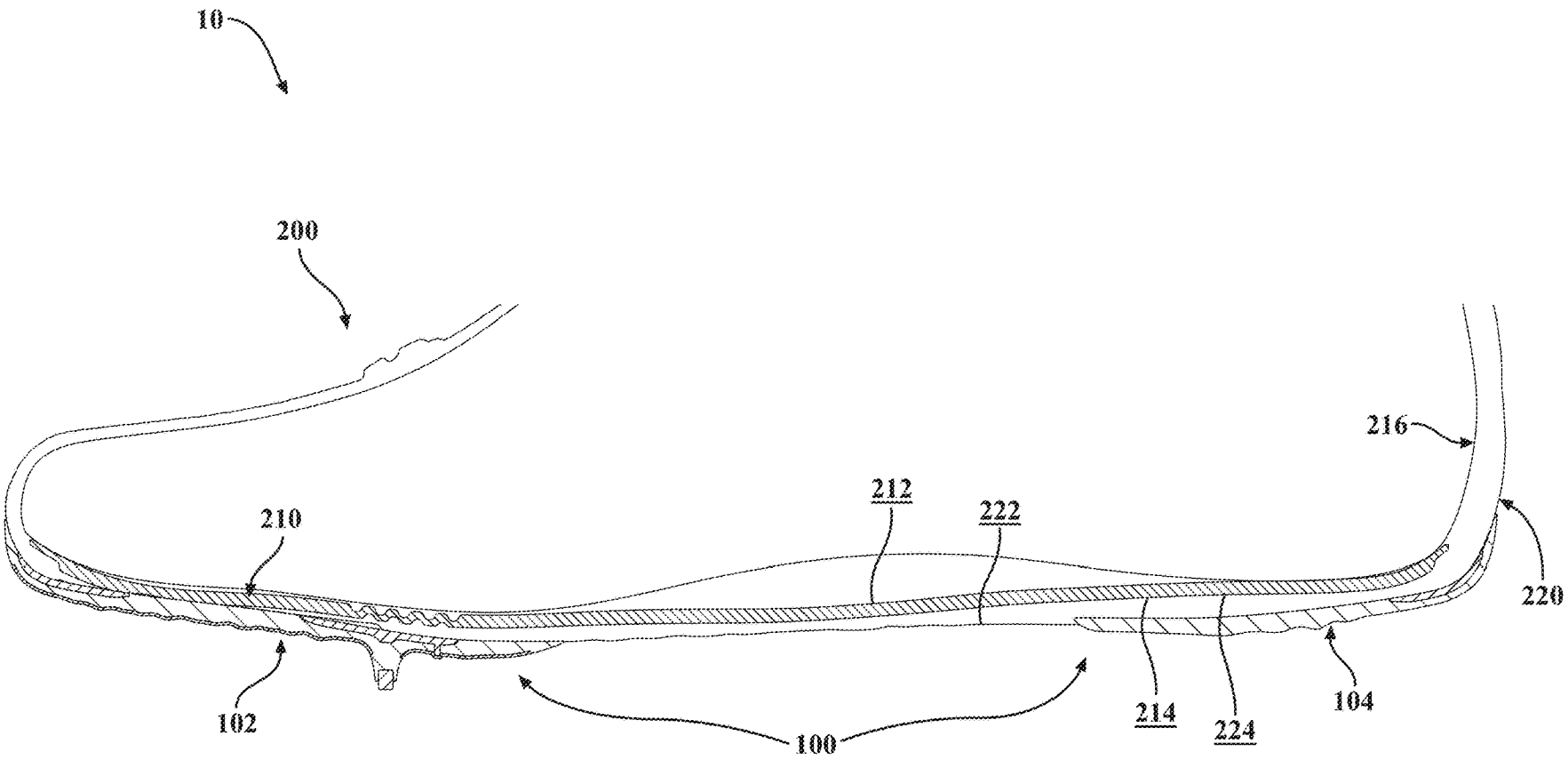
FIG. 3 is a cross-sectional view of the article of footwear of FIG. 1, taken along Line 3-3 in FIG. 1.
Figure 4:
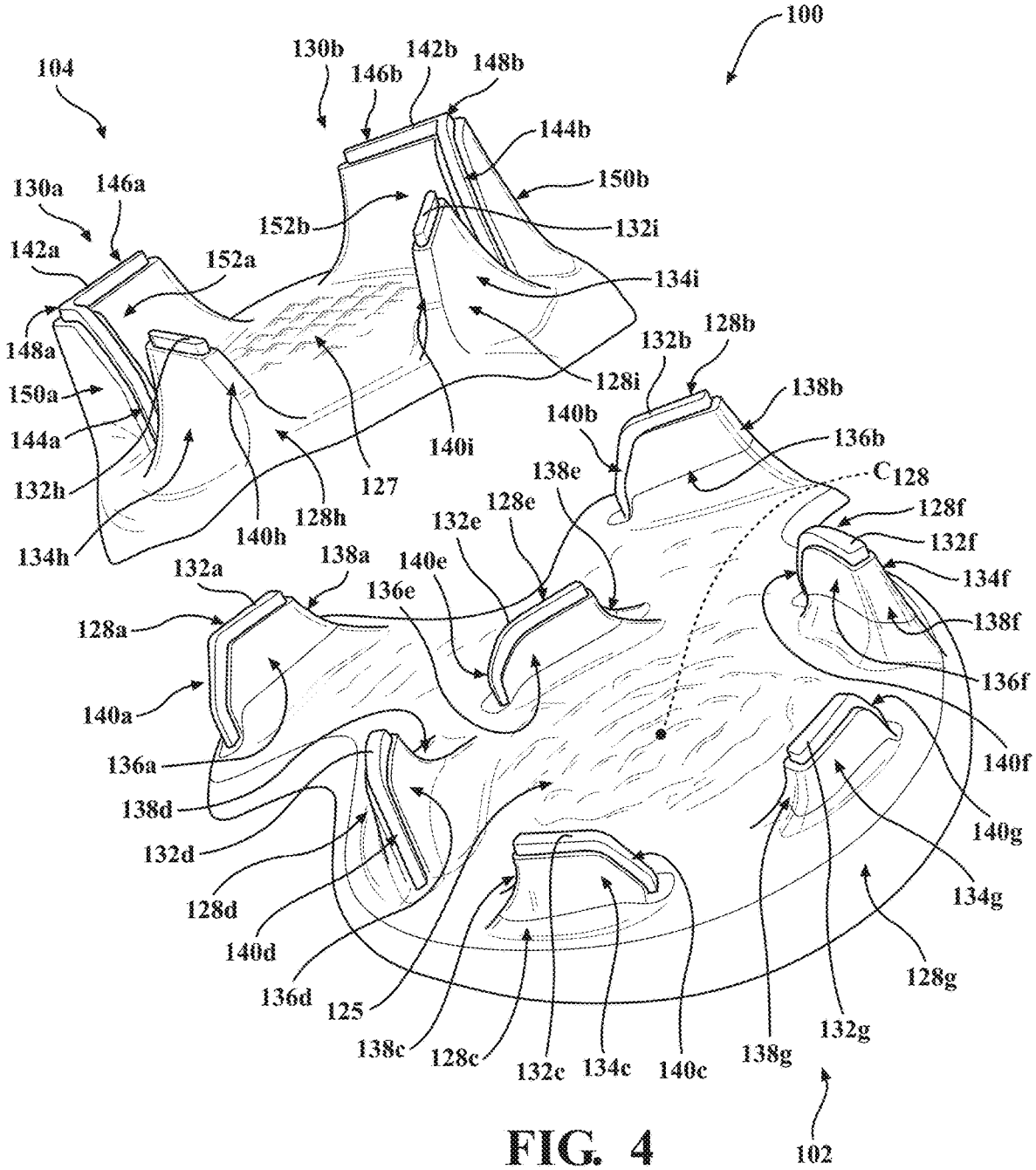
FIG. 4 is bottom-front perspective view of a sole structure according to the present disclosure.

Referring to FIGS. 1-3, an article of footwear 10 includes a sole structure 100 and an upper 200 attached to the sole structure 100. The article of footwear 10 may further include an anterior end 12 associated with a forward-most point of the footwear 10, and a posterior end 14 corresponding to a rearward-most point of the footwear 10. A longitudinal axis Ajo of the footwear 10 extends along a length of the footwear 10 from the anterior end 12 to the posterior end 14 parallel to a ground surface, and generally divides the footwear 10 into a medial side 16 and a lateral side 18. Accordingly, the medial side 16 and the lateral side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18.

The article of footwear 10 may be divided into one or more regions. The regions may include a forefoot region 20, a mid-foot region 22, and a heel region 24. The forefoot region 20 may correspond with the phalanges and the metatarsal bones of a foot. The mid-foot region 22 may correspond with an arch area of the foot, and the heel region 24 may correspond with rear portions of the foot, including a calcaneus bone.

The article of footwear 10, and more particularly, the sole structure 100, may be further described as including a peripheral region 26 and an interior region 28, as indicated in FIG. 1. The peripheral region 26 is generally described as being a region between the interior region 28 and an outer perimeter of the sole structure 100. Particularly, the peripheral region 26 extends from the forefoot region 20 to the heel region 24 along each of the medial side 16 and the lateral side 18, and wraps around each of the forefoot region 20 and the heel region 24. The interior region 28 is circumscribed by the peripheral region 26, and extends from the forefoot region 20 to the heel region 24 along a central portion of the sole structure 100. Accordingly, each of the forefoot region 20, the mid-foot region 22, and the heel region 24 may be described as including the peripheral region 26 and the interior region 28.

The upper 200 includes interior surfaces that define an interior void 202 configured to receive and secure a foot for support on the sole structure 100. The upper 200 may be formed from one or more materials that are stitched or adhesively bonded together to form the interior void 202. Suitable materials of the upper may include, but are not limited to, mesh, textiles, foam, leather, and synthetic leather. The materials may be selected and located to impart properties of durability, air-permeability, wear-resistance, flexibility, and comfort.

In some examples, one or more fasteners 204 extend along the upper 200 to adjust a fit of the interior void 202 around the foot and to accommodate entry and removal of the foot therefrom. The upper 200 may include apertures 206 such as eyelets and/or other engagement features such as fabric or mesh loops that receive the fasteners 204. The fasteners 204 may include laces, straps, cords, hook-and-loop, or any other suitable type of fastener. The upper 200 may include a tongue portion 208 that extends between the interior void 202 and the fasteners 204.

With reference to FIG. 3, in some examples, the article of footwear 10 includes a plate structure 210 (e.g., a light-weight plate structure) included in the upper 200. The plate structure 210 is configured to attenuate forces associated with impact of the sole structure 100 with a ground surface. As shown, the plate structure 210 includes a top surface 212 defining a footbed of the interior void 202 and a bottom surface 214 formed on an opposite side of the plate structure 210 than the top surface 212. The footbed may be contoured to conform to a profile of the bottom surface (e.g., plantar) of the foot. The upper 200 may also incorporate additional layers such as an insole 216 or sockliner that may be disposed on the plate structure 210 and reside within the interior void 202 of the upper 200 to receive a plantar surface of the foot to enhance the comfort of the article of footwear 10. An ankle opening 216 in the heel region 16 may provide access to the interior void 202. For example, the ankle opening 216 may receive a foot to secure the foot within the interior void 202 and to facilitate entry and removal of the foot from and to the interior void 202.

In some examples, the upper 200 includes a strobel 220 having a bottom surface 222 opposing the sole structure 100 and a top surface 224 opposing the bottom surface 214 of the plate structure 210. In some examples, the strobel 220 is attached to the upper 200 using stitching or adhesives. In the illustrated example, the upper 200 is formed as a unitary boot or sock, wherein the strobel 220 and the upper 200 are unitarily formed of a knitted material. Accordingly, the bottom surface 222 corresponds to both the strobel 220 and the upper 200. Optionally, the upper 200 may also incorporate additional layers such as one or more support plates (none shown).

With continued reference to FIG. 2, the sole structure 100 is attached to the bottom surface 222 of the upper 200 and includes a forefoot plate 102 disposed in the forefoot region 20 and a separate heel plate 104 disposed in the heel region 24. Accordingly, the mid-foot region 22 of the upper 200 may be exposed between the forefoot plate 102 and the heel plate 104. As described in greater detail below, the forefoot plate 102 and the heel plate 104 each include a plurality of ground-engaging members, which are configured to engage a soft or resilient ground surface. Each of the forefoot plate 102 and the heel plate 104 is formed of one or more rigid or semi-rigid materials. In some examples, the forefoot plate 102 and the heel plate 104 are formed of one or more polymeric materials. In other examples, one or both of the forefoot plate 102 and the heel plate 104 may include a composite material, such as a fiber-reinforced, composite material.

The forefoot plate 102 includes a top surface 106 (FIG. 5B) attached to the bottom surface 222 of the upper 200, a bottom surface 108 formed on an opposite side of the forefoot plate 102 from the top surface 106, and a peripheral side surface 110 extending between the top surface 106 and the bottom surface 108 and defining an outer peripheral profile of the forefoot plate 102. Likewise, the heel plate 204 includes a top surface 112 attached to the bottom surface 222 of the upper 200, a bottom surface 114 formed on an opposite side of the forefoot plate 102 from the top surface 112, and a peripheral side surface 116 extending between the top surface 112 and the bottom surface 114 and defining an outer peripheral profile of the heel plate 104. As discussed above, the forefoot plate 102 and the heel plate 104 are spaced apart from each other in the midfoot region 22 such that the bottom surface 222 of the upper 200 is exposed through the mid-foot region 14. Accordingly, the bottom surface 108 of the forefoot plate 102, the bottom surface 222 of the upper 200, and the bottom surface 114 of the heel plate 104 cooperate to define a ground-engaging surface 30 of the article of footwear 10.

Figure 5A:
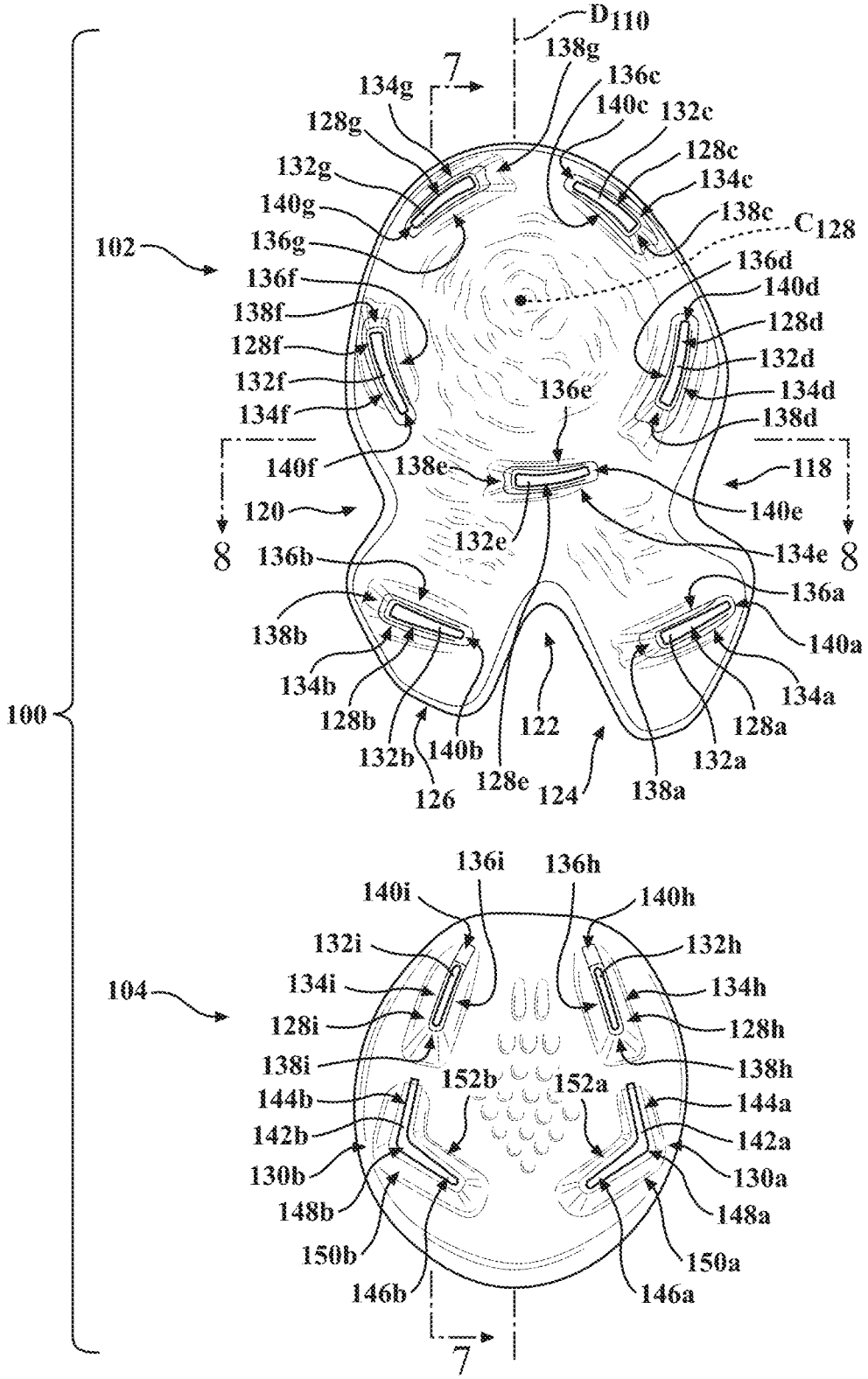
FIG. 5A is a bottom plan view of the sole structure of FIG. 4.
Figure 5B:
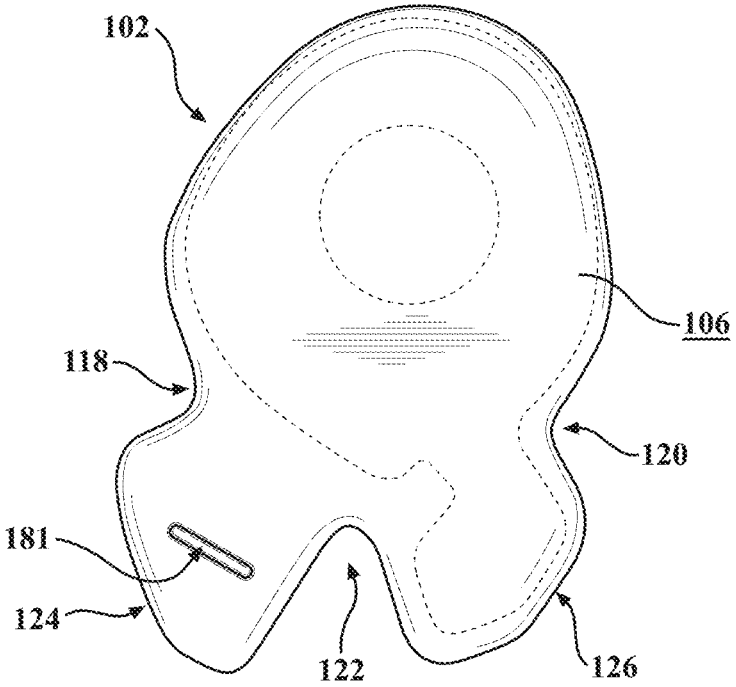
FIG. 5B is a top plan view of the sole structure of FIG. 4
Figure 5B:
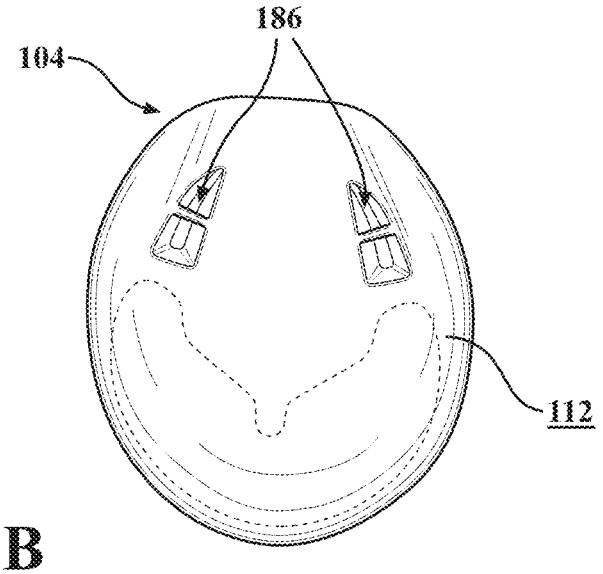

As best shown in FIGS. 2 and 5A, the peripheral side surface 110 of the forefoot plate 102 includes a lateral portion 110*a* extending along the lateral side 18 of the upper 200 from the mid-foot region 22 to the anterior end 12, a medial portion 110*b* extending along the medial side 16 of the upper 200 from the mid-foot region 22 to the anterior end 12, and a midfoot portion 110*c* connecting the lateral portion 110*a* and the medial portion 110*b* across the midfoot region 22.

In some examples, the lateral portion 110*a* of the peripheral side surface 110 may define a notch 118 on the lateral side 18 of the forefoot plate 102. The notch 118 may extend inwardly from the lateral side 18 at an oblique angle with respect to the longitudinal axis $A_{10}$ of the footwear 10. As shown, the notch 118 extends inwardly and towards the longitudinal axis $A_{10}$ of the footwear 10. Optionally, a width of the notch 218 may be tapered along a direction towards the longitudinal axis $A_{10}$.

The medial side surface 110*b* of the peripheral side surface 110 may define a notch 120 on the medial side 16 of the forefoot plate 102. In some instances, the notch 120 extends inwardly from the medial side 16 at an oblique angle with respect to the longitudinal axis $A_{10}$ of the footwear 10. Like the notch 118 on the lateral side 18, the notch 120 extends inwardly and towards the longitudinal axis $A_{10}$ of the footwear 10. Optionally, a width of the notch 120 may be tapered along a direction towards the longitudinal axis $A_{10}$. As shown in FIG. 5A, the notches 118, 120 may oppose one another across a width of the forefoot plate 102 in a direction extending between the medial side 16 and the lateral side 18.

The mid-foot portion 110*c* of the peripheral side surface 110 may form a notch 122 at a posterior end of the forefoot plate 102, between the lateral portion 110*a* and the medial portion 110*b*. As shown, the notch 122 extends inwardly from the posterior end at an oblique angle with respect to the longitudinal axis $A_{10}$ of the footwear 10. Like the notches 118, 120, the notch 122 extends inwardly and towards the longitudinal axis $A_{10}$ of the footwear 10. Optionally, a width of the notch 120 may be tapered along a direction towards the longitudinal axis $A_{10}$. As shown, the notch 118 and the notch 122 cooperate to define a first lobe 124 of the forefoot plate 102 disposed on the lateral side 18, while the notch 120 and the notch 122 cooperate to define a second lobe 126 of the forefoot plate 102 disposed on the medial side 16. While the notches 118, 120, 122 are shown with a tapered "V" shape, in other examples, the notches 118, 120, 122 may be arcuate, polygonal, or a combination of arcuate and polygonal.

The bottom surface 108 of the forefoot plate 102 includes a plurality of first traction elements 128 including a pair of rear first traction elements 128*a*, 128*b* and one or more forward first traction elements 128*c*-128*g*. As shown, the rear first traction elements 128*a*, 128*b* are disposed on each of the lobes 124, 126. Specifically, the rear first traction element 128*a* is disposed on the first lobe 124, while the rear first traction element 128*b* is disposed on the second lobe 126. The rear first traction elements 128*a*, 128*b* may be offset from one another along the longitudinal axis $A_{10}$ such that the rear first traction element 128*a* is further from the anterior end 12 than the rear first traction element 128*b*, as shown in FIG. 2. The forward first traction elements 128*c*-128*g* are arranged in an approximately circular grouping with a center point $C_{128}$ substantially aligned with the longitudinal axis $A_{10}$.

The heel plate 104 of the sole structure 100 is located in the heel region 24 adjacent the posterior end 14. As with the forefoot plate 102, the heel plate 104 includes a plurality of first traction elements 128. Specifically, the heel plate 104 includes a pair of forward first traction elements 128*h*, 128*i*. Additionally, the heel plate 104 includes a pair of second traction elements 130*a*, 130*b* located primate to the posterior end 14 of the article of footwear 10. In some examples, the forefoot plate 102 may further include at least one serrated region 125 formed in the interior region 26 of the bottom surface 108, and the heel plate 104 may include a serrated region 127 formed in the interior region 26 of the bottom surface 114.

In the illustrated example, each of the first traction elements 128 extend from the bottom surfaces 108, 114 to a distal end 132*a*-132*i* facing away from the bottom surfaces 108, 114 and forming an elongated substantially rectangular body. Each distal end 132 of the first traction elements 132*a*-132*i* forms a ground-contacting surface of each respective first traction element 128. Each of the first traction elements 128*a*-128*i* further includes an outer surface 134*a*-134*i*, an inner surface 136*a*-136*i* formed on an opposite side of the traction element 128 than the outer surface 134*a*-134*i*, a first side surface 138*a*-138*i*, and a second side surface 140*a*-140*i* formed on an opposite side of the traction element 128 than the first side surface 138*a*-138*i*. As shown, the first side surfaces 138*a*-138*i* are generally concave, while the second side surfaces 140*a*-140*i* taper along a length of the traction element 128 as it extends from the bottom surfaces 108, 114 to the distal ends 132*a*-132*i*.

As described above, the first traction elements 128*a*-128*g* disposed on the forefoot plate 102 are generally centered with respect to the center point $C_{128}$ of the forefoot plate 102. Accordingly, the outer surfaces 134*a*-134*i* generally face away from the center point $C_{128}$ of the forefoot plate 102, while the inner surfaces 136*a*-136*i* face in toward the center point $C_{128}$ of the forefoot plate 102. The first traction elements 128*h*, 128*i* disposed on the heel plate 104 face one another, such that the inner surfaces 134*h*, 134*i* face one another, while the outer surfaces 132*h*, 132*i* face away from one another.

Still referring to FIG. 2, the second traction elements 130*a*, 130*b* extend from the bottom surface 114 of the heel plate 104 to a distal end 142*a*, 142*b* having a generally chevron-shaped configuration. The second traction elements 130*a*, 130*b* further include a first edge 144*a*, 144*b* and a second edge 146*a*, 146*b* extending in opposite directions from a central portion 148*a*, 148*b* of the second traction elements 130*a*, 130*b*. As shown, the first edge 142 and the second edge 144 of each second traction element 130*a*, 130*b* cooperate to define a convex or pointed leading face 150*a*, 150*b* and a concave or cupped trailing face 152*a*, 152*b* formed on an opposite side of the second traction element 130*a*, 130*b* from the leading face 150*a*, 150*b*. The second traction elements 130*a*, 130*b* are arranged such that their trailing faces 152*a*, 152*b* face one another, while their leading faces 150*a*, 150*b* face away from one another.

Figure 6A:
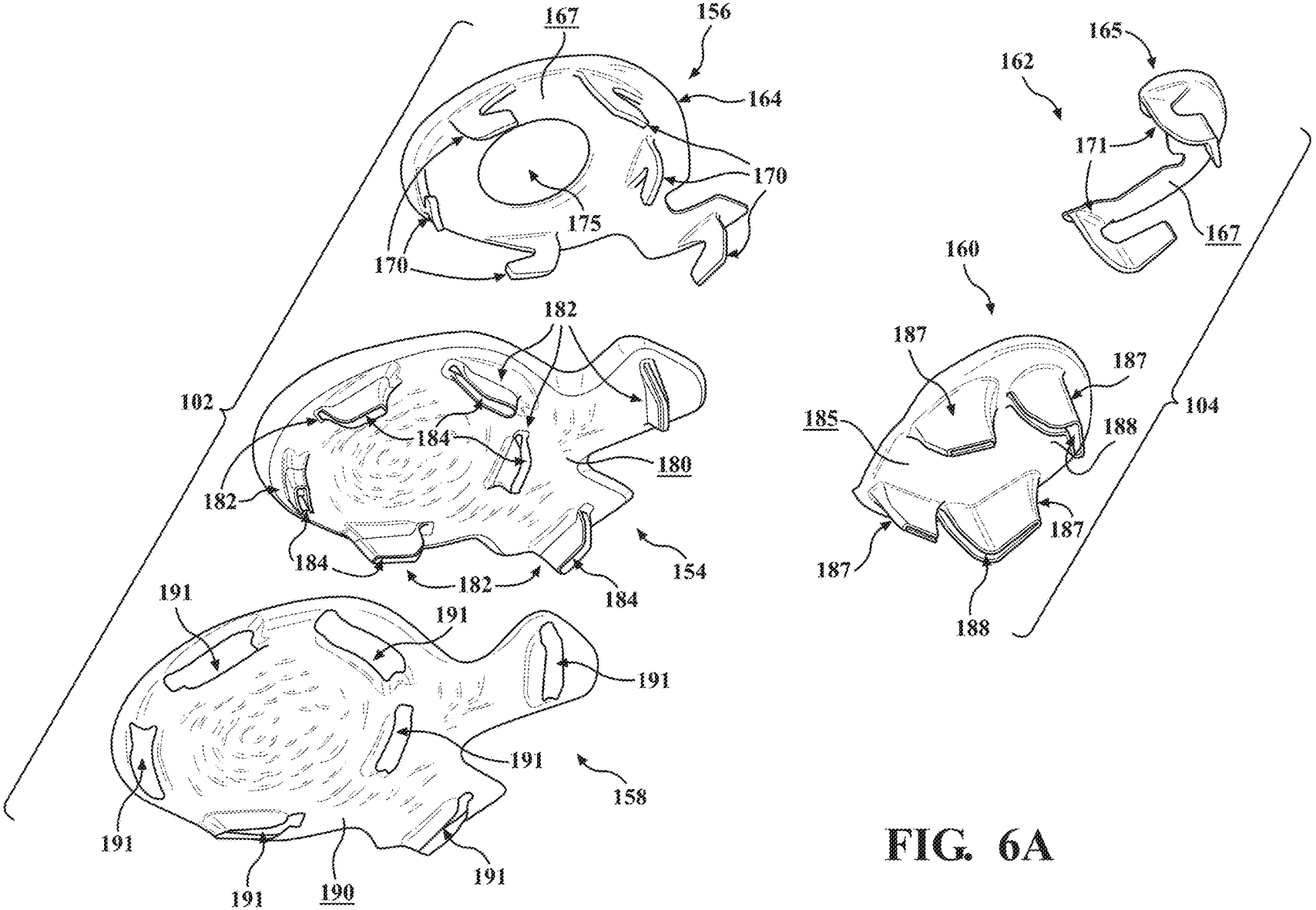
FIG. 6A is bottom-front exploded perspective view of the sole structure of FIG. 4
Figure 6B:
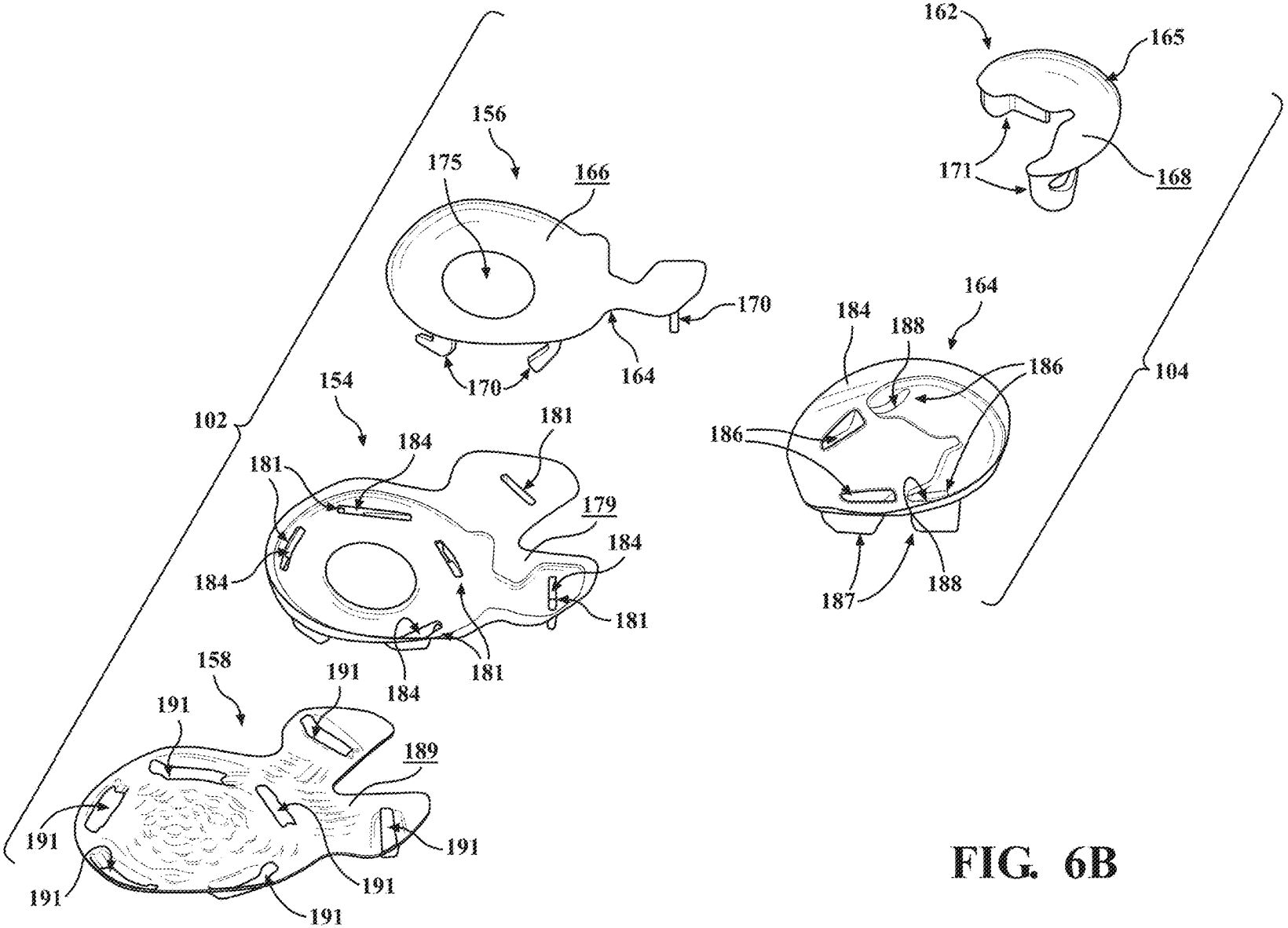
FIG. 6B is a top-front exploded perspective view of the sole structure of FIG. 4.
Figure 7:
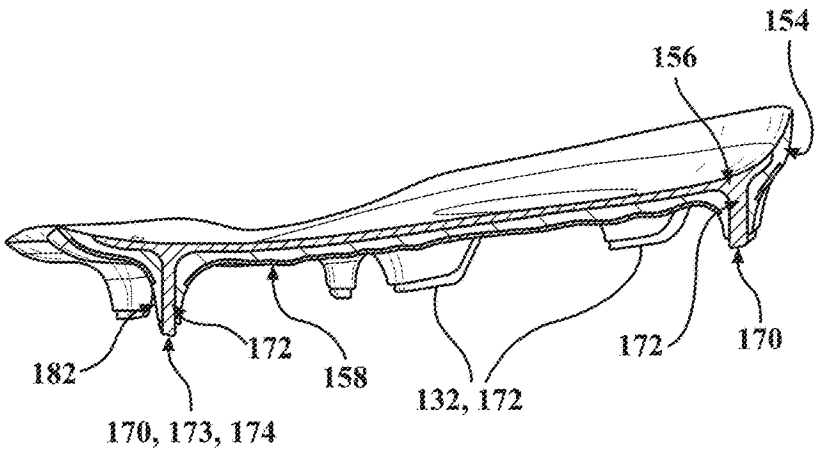
FIG. 7 is a cross-sectional view of the sole structure of FIG. 4, taken along Line 7-7 in FIG. 5A.
Figure 7:
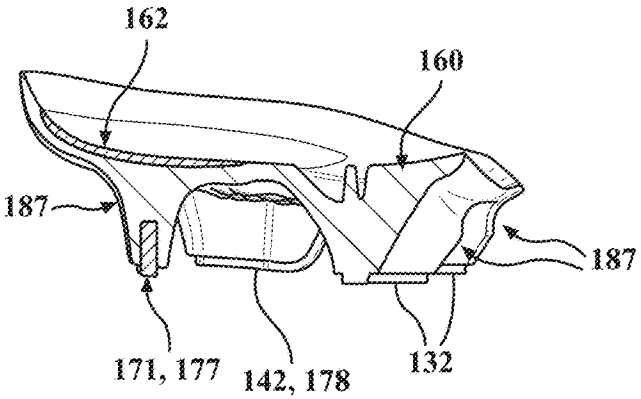
Figure 8:
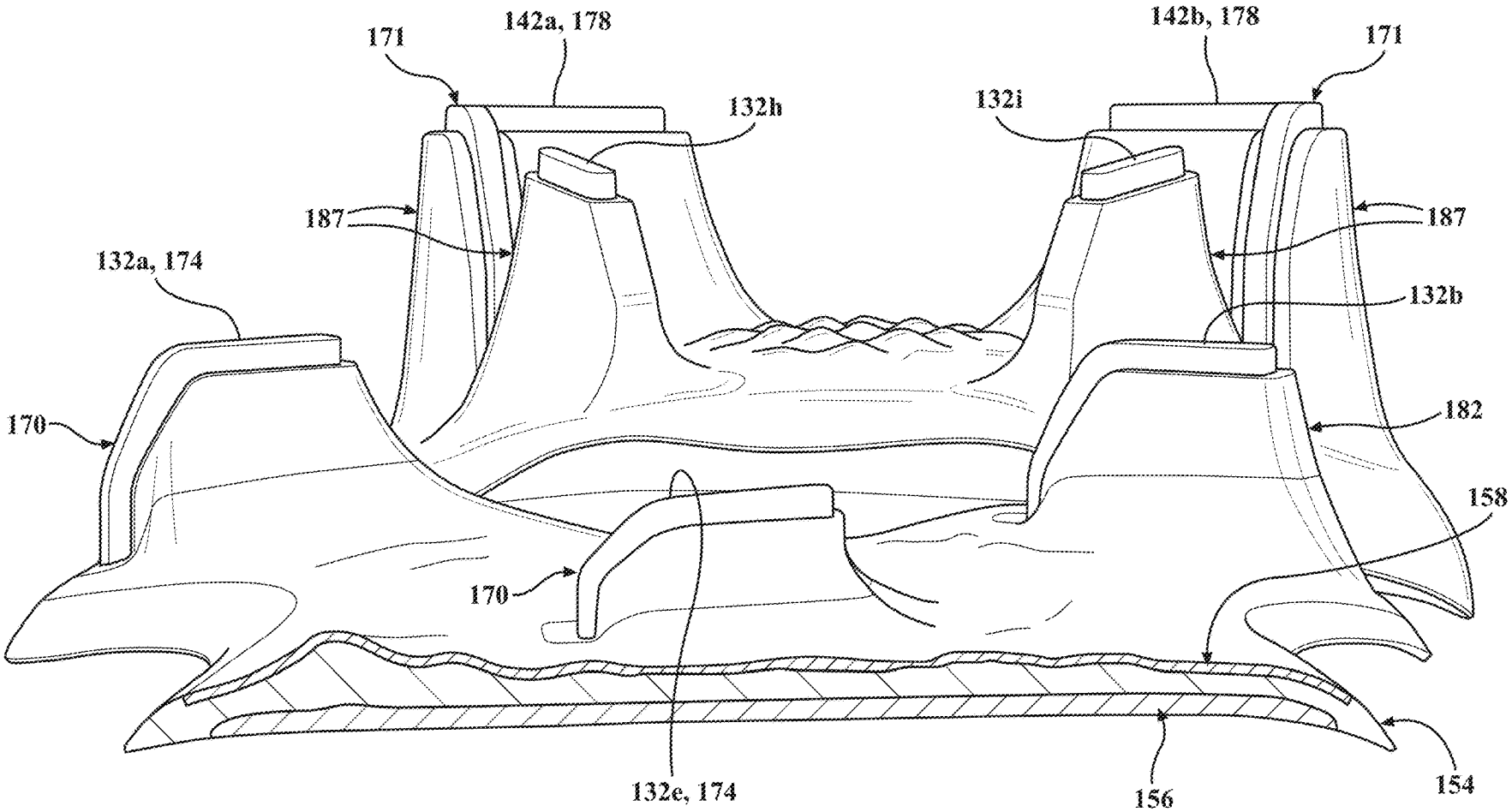
FIG. 8 is a cross-sectional view of the sole structure of FIG. 4, taken along Line 8-8 in FIG. 5A.

FIGS. 6A and 6B provide an exploded view of the plate structure 100. Unlike conventional plate structures, which include monolithic materials, the plate structure 100 of the present disclosure is configured as a composite structure including a plurality of components joined together. For example, the plate structure 100 includes baseplates 154, 160 located between bridges 156, 162, and an outsole plate 158. As discussed further below, by integrating bridges 156, 162 into the plate structure 100, the plate structure 100 may significantly cut down on manufacturing waste while increasing the stability of traction elements of the sole structure 100.

With reference to FIGS. 6A-8, components of the forefoot plate 102 of the sole structure 100 further include a forefoot baseplate 154, a forefoot bridge 156, and an outsole plate 158. Additionally, the heel plate 104 of the sole structure 100 includes a heel baseplate 160 and a heel bridge 162. Suitable materials for the forefoot bridge 156 and the heel bridge 162 include, but are not limited to, thermoplastic polyurethanes (TPUs), polyolefins, polyolefin based elastomers, and nylons, as these materials provide superior abrasion properties. Suitable materials for the forefoot baseplate 154, the outsole plate 158, and the heel baseplate 160 include, but are not limited to, TPUs, nylons, copolyamides, and polyolefins. In some examples, the forefoot bridge 156 and the heel bridge 162 are formed from a different material than the forefoot baseplate 154 and the heel baseplate 160. In other examples, all of the components of the forefoot plate 102 and the heel plate 104 are formed from the same material.

Figure 9:
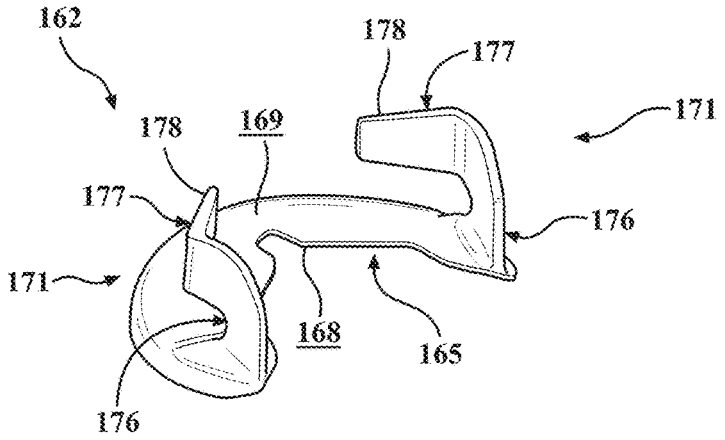
FIG. 9 is a bottom-front perspective view of a bridge of the sole structure in accordance with the principles of the present disclosure.
Figure 9:
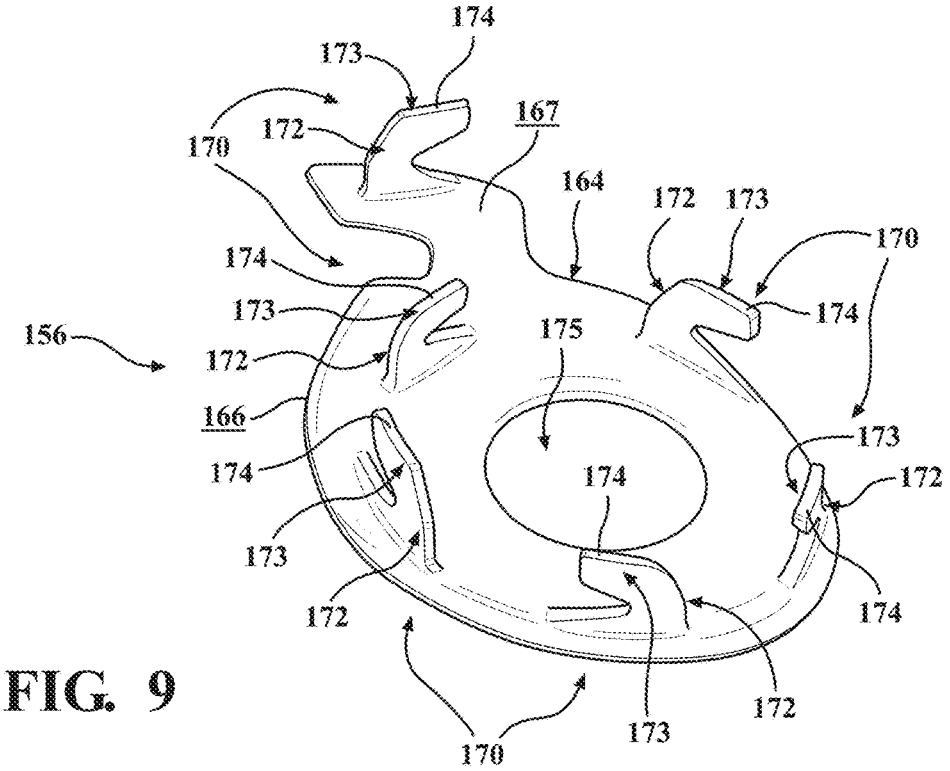

As shown in FIGS. 6A, 6B, and 9, the forefoot bridge 156 and the heel bridge 162 may further be defined by plates 164, 165, central first traction elements 170, and central second traction elements 171. The plate 164 of the forefoot bridge 156 includes a top surface 166 and a bottom surface 167 formed an opposite side from the plate 164 than the top surface 166, and connects the central first traction elements 170 to one another. Likewise, the plate 165 of the heel bridge 162 includes a top surface 168 and a bottom surface 169 formed on an opposite side from the plate 165 than the top surface 168, and connects the central first traction elements 170 and the central second traction elements 171 to one another. The central first traction elements 170 generally correspond to the first traction elements 128*b*-128*g* of the resulting sole structure 100, while the central second traction elements 171 generally correspond to the second traction elements 130*a*, 130*b* of the resulting sole structure. As shown, the forefoot bridge 156 may further include an aperture 175 formed through a thickness of the plate 164 between the top surface 166 and the bottom surface 167.

Referring to FIG. 9, each of the central first traction elements 170 includes a first leg 172 extending substantially perpendicular from the bottom surface 167 of the plate 164, and a second leg 173 extending substantially perpendicular from the first leg 172. In other words, the second leg 173 is substantially parallel with the bottom surface 167 of the plate 164 (i.e., the forefoot bridge 156) and defines a distal end 174 of each of the central first traction elements 170. The distal ends 174 of the central first traction elements 170 generally correspond to the distal ends 132*b*-132*g* of the first traction elements 128*b*-128*g* of the sole structure 100. Similarly, each of the central second traction elements 171 includes a first leg 176 extending substantially perpendicular from the bottom surface 169 of the plate 165, and a second leg 177 extending substantially perpendicular from the first leg 176. In other words, the second leg 177 is substantially parallel with the bottom surface 169 of the plate 165 (i.e., the heel bridge 162) and defines a distal end 178 of each of the central second traction elements 171. The distal ends 178 of the central second traction elements 171 generally correspond to the distal ends 142*a*, 142*b* of the second traction elements 130*a*, 130*b* of the sole structure 100.

Figure 10:
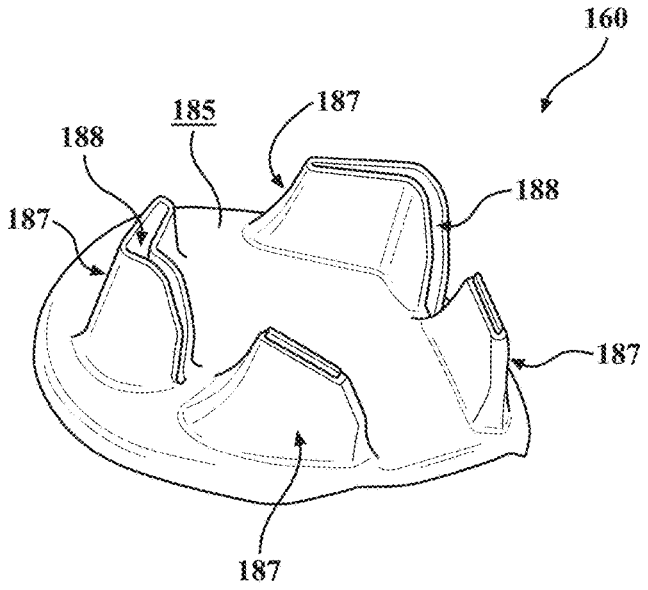
FIG. 10 is a bottom-front perspective view of a baseplate of the sole structure of the present disclosure.
Figure 10:
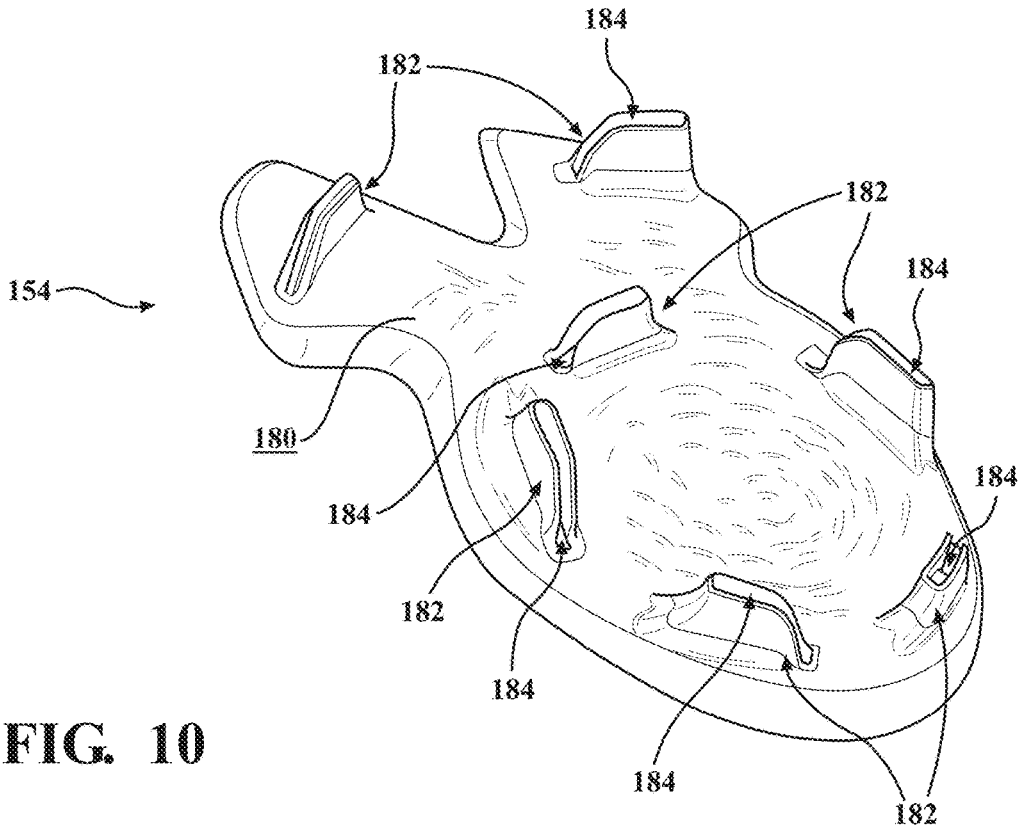

As shown in FIGS. 6A, 6B, and 10, the forefoot baseplate 154 is defined by a top surface 179 and a bottom surface 180 formed on an opposite side of the forefoot baseplate 154 than the top surface 179. The top surface 179 includes recesses that form recessed cavities 181 that extend out from the bottom surface 180 to form outer first traction elements 182. In some examples, at least two of the recessed cavities 181 are sized to receive the central first traction elements 170 of the forefoot bridge 156. In these examples, the outer first traction elements 182 include apertures 184 that wrap around and receive the central first traction elements 170 to form the first traction elements 128 of the sole structure 100, where the distal ends 174 of the central first traction elements 170 extend through and beyond the outer first traction elements 182 to define the distal ends 132 of the first traction elements 128. In some examples, at least one of the outer first traction elements 182 forms the entire first traction element 128 including the distal end 132 of the first traction element 128.

The heel baseplate 160 is defined by a top surface 184 and a bottom surface 185 formed on an opposite side of the heel baseplate 160 than the top surface 184. The top surface 184 includes recesses that form recessed cavities 186 that extend out from the bottom surface 185 to form outer second traction elements 187. In some examples, one or more of the recessed cavities 186 is sized to receive a central second traction element 171 of the heel bridge 162. In these examples, the outer second traction elements 187 include apertures 188 that wrap around and receive the central second traction elements 171 to form the second traction elements 130 of the sole structure 100. Once assembled, the distal ends 178 of the central second traction element 171 extend through and beyond the outer second traction element 187 to define the distal end 142 of the second traction element 130. In some examples, at least one of the outer second traction elements 187 forms an entire first traction element 128 including the distal end 132 of the first traction element 128.

Figure 11:
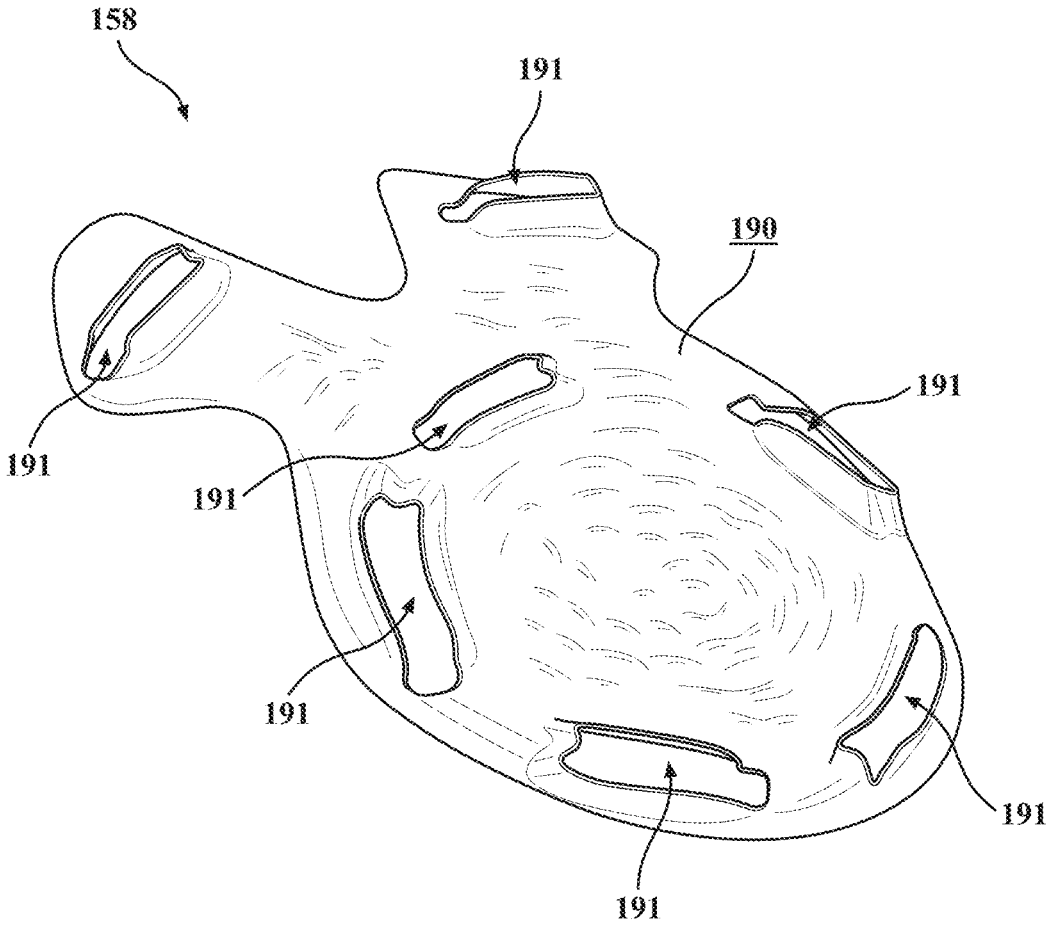
FIG. 11 is a bottom-front perspective view of an outsole plate of the sole structure of the present disclosure.

Referring to FIGS. 6A, 6B, and 11, the forefoot plate 102 may further include an outsole plate 158. As discussed above, the outsole plate 158 may provide the sole structure 100 with additional traction and abrasion properties. The outsole plate 158 is further defined by a top surface 189 and a bottom surface 190 formed on an opposite side of the outsole plate 158 than the top surface 189. The top surface 189 includes one or more recessed apertures 191 that are generally disposed in locations corresponding to the outer first traction elements 182 of the forefoot baseplate 154. The recessed apertures 191 may be sized to receive the outer first traction elements 182 such that the outer first traction elements 182 extend through the recessed apertures 191 of the outsole plate 158. In some implementations (not shown), the sole structure 100 may be formed without the outsole plate 158.

To form the final structure of the sole structure 100, as shown in FIGS. 4, 5A, 5B, 7, and 8, the components of the forefoot plate 102, and the heel plate 104 are injection molded in sequence. While a typical injection process uses a runner system to separately mold traction elements, whereby the plastic used in the runner system is lost as waste, the sole structure 100 integrates the runner structure into the sole structure 100 by including the runner system as the plates 164, 165 of the forefoot bridge 156 and the heel bridge 162. For example, the forefoot bridge 156 and the heel bridge 162 may be injection molded, through a combination of pressure and heat, to form the plates 164, 165, the central first traction elements 170, and the central second traction elements 171, thereby minimizing the amount of waste necessary to produce the sole structure 100. Due to the injection molding process, the components of the forefoot bridge 156 and the heel bridge 162 (i.e., the plates 164, 165, the traction elements 170, 171, and the legs 172, 173, 176, 177) are all integrally formed together and separately formed from the baseplates 154, 160.

Next, the forefoot baseplate 154 and the heel baseplate 160 may be injection molded over the forefoot bridge 156 and the heel bridge 162. For example, the forefoot bridge 156 and the heel bridge 162 may be disposed within a mold cavity and subjected to a combination of pressure and heat, whereby resin is delivered to the mold cavity to form the forefoot baseplate 154 and the heel baseplate 160 around the forefoot bridge 156 and the heel bridge 162 respectively. This also forms the outer first traction elements 182 and the outer second traction elements 187, which wrap around and further reinforce the central traction elements 170, 171 to form the resulting traction elements 128, 130. In some implementations, the outsole plate 156 is further molded to the forefoot baseplate 154 to increase the traction and rigidity of the forefoot plate 102. In other implementations, a different sequence for forming the sole structure 100 may be used. For example, the process may include injection molding the forefoot baseplate 154 and the heel baseplate 160 first, and then injecting the forefoot bridge 156 and the heel bridge 162.

Referring again to FIG. 1, the upper 200 may be formed from one or more materials that are stitched or adhesively bonded together to define the interior void 202. Suitable materials of the upper 200 may include, but are not limited to, textiles, foam, leather, and synthetic leather. The example upper 200 may be formed from a combination of one or more substantially inelastic or non-stretchable materials and one or more substantially elastic or stretchable materials disposed in different regions of the upper 200 to facilitate movement of the article of footwear 10 between the tightened state and the loosened state. The one or more elastic materials may include any combination of one or more elastic fabrics such as, without limitation, spandex, elastane, rubber or neoprene. The one or more inelastic materials may include any combination of one or more of thermoplastic polyurethanes, nylon, leather, vinyl, or another material/fabric that does not impart properties of elasticity.

The following Clauses provide an exemplary configuration for a sole structure for an article of footwear, an article of footwear, and a composite structure described above.

Clause 1. A sole structure for an article of footwear, the sole structure comprising a baseplate defining a ground-contacting surface of the sole structure and at least two ground-engaging members extending from the ground-contacting surface and including a first portion and a second portion, the first portions of the ground-engaging members being connected to one another by a bridge formed separately from the baseplate.

Clause 2. The sole structure of Clause 1, wherein the first portions of the at least two ground-engaging members are integrally formed with the bridge.

Clause 3. The sole structure of any of the preceding Clauses, wherein the first portions of the at least two ground-engaging members are formed from a different material than a material forming the baseplate.

Clause 4. The sole structure of any of the preceding Clauses, wherein the second portions of the at least two ground-engaging members are formed from the same material as a material forming the baseplate.

Clause 5. The sole structure of any of the preceding Clauses, wherein the second portions of the at least two ground-engaging members are integrally formed with the baseplate.

Clause 6. The sole structure of any of the preceding Clauses, wherein the first portions of the at least two ground-engaging members include a first leg extending substantially perpendicular to the ground-contacting surface and a second leg extending from the first leg.

Clause 7. The sole structure of Clause 6, wherein the second leg extends substantially perpendicular to the first leg.

Clause 8. The sole structure of Clause 6, wherein the second leg extends substantially parallel to the ground-contacting surface.

Clause 9. The sole structure of Clause 6, wherein the second leg defines a distal end of the at least two ground-engaging members.

Clause 10. An article of footwear incorporating the sole structure of any of the preceding Clauses.

Clause 11. A sole structure for an article of footwear, the sole structure comprising a baseplate defining a ground-contacting surface of the sole structure and at least two ground-engaging members extending from the ground-contacting surface and including a first portion and a second portion, the first portions of the at least two ground-engaging members being connected to one another by a bridge with the ground-contacting surface extending (i) between and separating the first portions of the at least two ground-engaging members and (ii) substantially parallel to the bridge.

Clause 12. The sole structure of Clause 11, wherein the first portions of the at least two ground-engaging members are integrally formed with the bridge.

Clause 13. The sole structure of any of the preceding Clauses, wherein the first portions of the at least two ground-engaging members are formed from a different material than a material forming the baseplate.

Clause 14. The sole structure of any of the preceding Clauses, wherein the second portions of the at least two ground-engaging members are formed from the same material as a material forming the baseplate.

Clause 15. The sole structure of any of the preceding Clauses, wherein the second portions of the at least two ground-engaging members are integrally formed with the baseplate.

Clause 16. The sole structure of any of the preceding Clauses, wherein the first portions of the at least two ground-engaging members include a first leg extending substantially perpendicular to the ground-contacting surface and a second leg extending from the first leg.

Clause 17. The sole structure of Clause 16, wherein the second leg extends substantially perpendicular to the first leg.

Clause 18. The sole structure of Clause 16, wherein the second leg extends substantially parallel to the ground-contacting surface.

Clause 19. The sole structure of Clause 16, wherein the second leg defines a distal end of the at least two ground-engaging members.

Clause 20. An article of footwear incorporating the sole structure of any of the preceding Clauses.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a baseplate defining a ground-contacting surface of the sole structure;

a first plurality of traction elements extending from the ground-contacting surface, traction elements of the first plurality of traction elements being spaced apart from one another and cooperating to form a circular pattern; and a second plurality of traction elements extending from the ground-contacting surface and being disposed closer to a posterior end of the sole structure than the first plurality of traction elements, traction elements of the second plurality of traction elements spaced apart from one another and extending along an arc having a different radius than a radius of the circular pattern, the circular pattern and the arc each being centered around a center point of the baseplate.

2. The sole structure of claim 1, wherein the radius of the arc is larger than the radius of the circular pattern.

3. The sole structure of claim 1, wherein the baseplate includes a first projection extending away from the circular pattern in a first direction toward the posterior end of the sole structure and a second projection spaced apart from the first projection and extending from the circular pattern in a second direction toward the posterior end of the sole structure.

4. The sole structure of claim 3, wherein the first direction and the second direction are convergent.

5. The sole structure of claim 3, wherein a first traction element of the second plurality of traction elements extends from the first projection and a second traction element of the second plurality of traction elements extends from the second projection.

6. The sole structure of claim 1, wherein traction elements of the first plurality of traction elements are elongate.

7. The sole structure of claim 6, wherein traction elements of the second plurality of traction elements are elongate.

8. The sole structure of claim 1, wherein traction elements of the first plurality of traction elements include a leading end and a trailing end, a width of the traction elements of the first plurality of traction elements tapering in thickness from the trailing end to the leading end.

9. The sole structure of claim 8, wherein the leading end of a first traction element of the first plurality of traction elements opposes the trailing end of an adjacent second traction element of the first plurality of traction elements.

10. The sole structure of claim 8, wherein the leading end of a first traction element of the first plurality of traction elements is aligned with the trailing end of an adjacent second traction element of the first plurality of traction elements.

11. A sole structure for an article of footwear, the sole structure comprising:

a baseplate defining a ground-contacting surface of the sole structure;

a first plurality of traction elements extending from the ground-contacting surface, traction elements of the first plurality of traction elements being spaced apart from one another and cooperating to form a circular pattern; and a second plurality of traction elements extending from the ground-contacting surface, being disposed closer to a posterior end of the sole structure than the first plurality of traction elements, and extending along an arc, a first traction element of the second plurality of traction elements spaced apart from and opposing a first gap formed between a first pair of adjacent traction elements of the first plurality of traction elements and a second traction element of the second plurality of traction elements spaced apart from and opposing a second gap formed between a second pair of adjacent traction elements of the first plurality of traction elements, the circular pattern and the arc each being centered around a center point of the baseplate.

12. The sole structure of claim 11, wherein the first pair of traction elements and the second pair of traction elements share a common traction element of the first plurality of traction elements.

13. The sole structure of claim 11, wherein the baseplate includes a first projection extending away from the circular pattern in a first direction toward the posterior end of the sole structure and a second projection spaced apart from the first projection and extending from the circular pattern in a second direction toward the posterior end of the sole structure.

14. The sole structure of claim 13, wherein the first direction and the second direction are convergent.

15. The sole structure of claim 13, wherein the first traction element of the second plurality of traction elements extends from the first projection and the second traction element of the second plurality of traction elements extends from the second projection.

16. The sole structure of claim 11, wherein traction elements of the first plurality of traction elements are elongate.

17. The sole structure of claim 16, wherein traction elements of the second plurality of traction elements are elongate.

18. The sole structure of claim 11, wherein traction elements of the first plurality of traction elements include a leading end and a trailing end, a width of the traction elements of the first plurality of traction elements tapering in thickness from the trailing end to the leading end.

19. The sole structure of claim 18, wherein the leading end of a first traction element of the first plurality of traction elements opposes the trailing end of an adjacent second traction element of the first plurality of traction elements.

20. The sole structure of claim 18, wherein the leading end of a first traction element of the first plurality of traction elements is aligned with the trailing end of an adjacent second traction element of the first plurality of traction elements.

* * * * *